United States Patent [19]

Winston

[11] 4,067,078

[45] Jan. 10, 1978

[54] ADJUSTABLE BACK SUPPORTER

[76] Inventor: Emanuel A. Winston, 190A Skokie Valley Road, Highland Park, Ill. 60035

[21] Appl. No.: 694,824

[22] Filed: June 10, 1976

[51] Int. Cl.[2] ..... A47C 27/14; A47C 27/08

[52] U.S. Cl. ..... 5/368; 297/284; 297/231; 5/365

[58] Field of Search ..... 297/284, 231; 5/365, 5/367–370, 349, 350; 128/403

[56] References Cited

U.S. PATENT DOCUMENTS

| | | | |
|---|---|---|---|
| 2,245,909 | 6/1941 | Enfiajian | 5/367 |
| 3,112,956 | 12/1963 | Schick et al. | 5/349 X |
| 3,192,541 | 7/1965 | Moore | 297/284 X |
| 3,226,601 | 6/1967 | Vanderbilt et al. | 297/284 |
| 3,271,797 | 9/1966 | Boyce | 5/367 |
| 3,348,880 | 10/1967 | Swann | 297/284 X |
| 3,363,941 | 1/1968 | Wierwille | 297/284 |

*Primary Examiner*—Casmir A. Nunberg
*Attorney, Agent, or Firm*—Stefan M. Stein; Robert F. Frijouf

[57] ABSTRACT

An adjustable back support comprising a plurality of individual compartments which may be either equally or variably dimensioned to hold predetermined amounts of fluid therein. Fluid, either in the form of air or liquid, or both, are introduced into the fluid segregated compartments so as to expand the various compartments a predetermined amount in conformity to portions of a user's back. The compartments may be arranged in longitudinally aligned sets so as to provide greater versatility in conforming the individual portions or compartments of the back support to the body of the user. The valve assemblies may include both fluid and liquid flow valves such that heated fluid, either in the form of air or liquid, may be introduced into one or all of the various compartments to provide maximum comfort to the user.

8 Claims, 6 Drawing Figures

FIG. 1
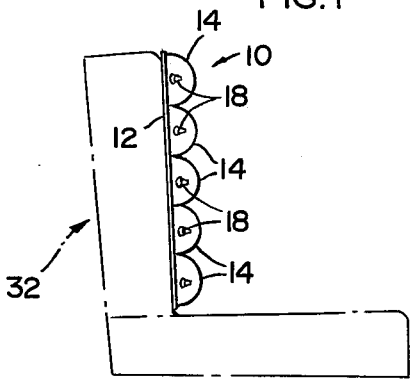
FIG. 2
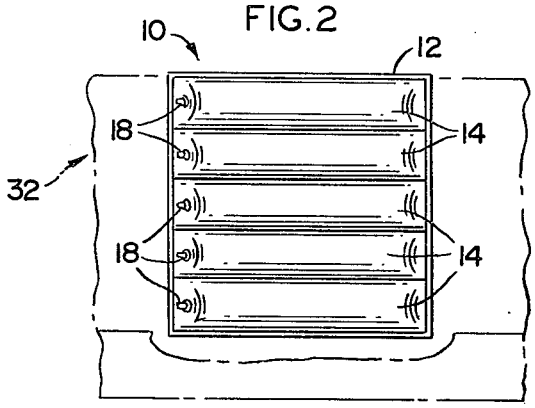
FIG. 4
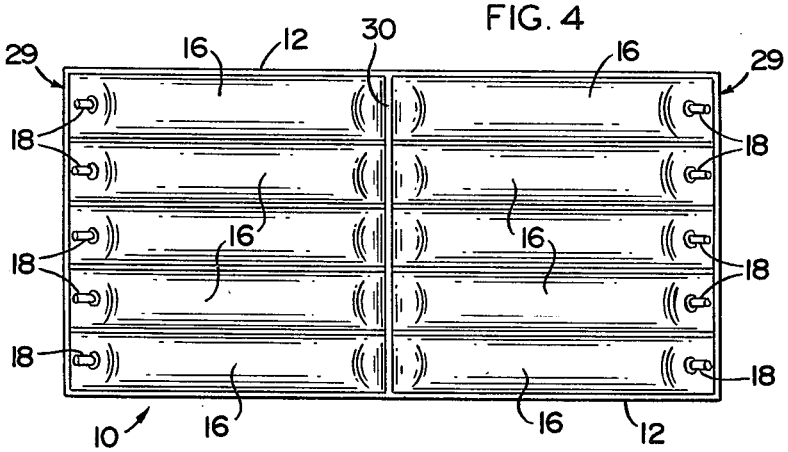
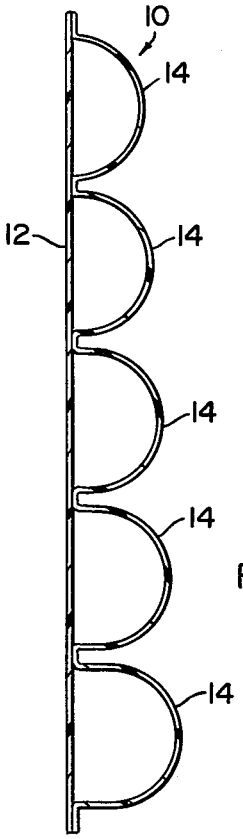
FIG. 3
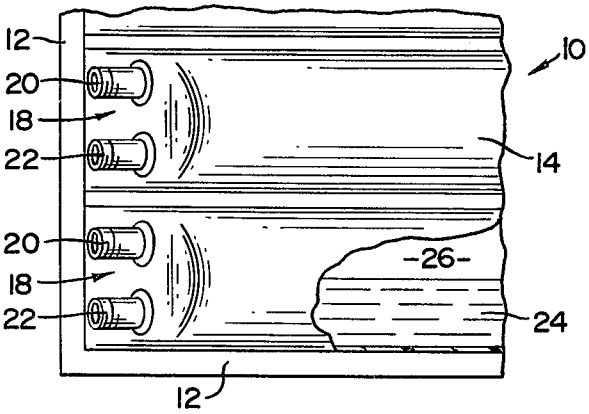
FIG. 5
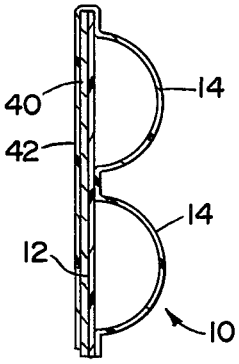
FIG. 6

ADJUSTABLE BACK SUPPORTER

BACKGROUND OF THE INVENTION

1. Field of the Invention

This invention relates to an adjustable back support of the type designed to be used with an already existing chair or like member wherein each of the various compartments comprising the support are segregated from one another such that the volume of fluid or air within the compartment, and accordingly, its shape, may be individually varied to conform to the back portion of the user and thereby exert proper support or pressure at the intended regions thereof.

2. Description of the Prior Art

A plurality of support or mattress-type structures are presently available in the prior art. A great plurality of these prior art structures are specifically intended to be conformable to the shape of all or a portion of the body of the user. Generally, this is accomplished by providing a plurality of individual sections, all of substantially identical configuration and structure which are somehow separated from one another so as to provide what may be referred to as independent or individual supports. For example, the U.S. Pat. No. 2,451,150 to Stein, discloses a pneumatic mattress used for upholstery and cushioning and structured to have inflatable cellular cores adapted to service the foundation of the particular upholstery in which the mattress or cushion is used.

Along these lines, numerous prior art devices provide the intended support or "cushion" feature through the inflation of the support structure with air, liquid or some type fluid. For example, the two U.S. Pat. Nos. 2,136,510 to Jensen and 3,128,125 to Loewy, both disclose pneumatic car seats which are selectively inflatable to meet different requirements of the various users.

Yet another example of prior art structures is disclosed in the U.S. Pat. No. 3,112,956, to Schick, disclosing an inflatable seat and back rest. This type of structure is specifically designed to be placed on the surface of an existing chair or seat-like member and be positioned between the body of the user and the supporting chair. While this structure has a plurality of specifically shaped compartments, basically, the entire base and/or top section are inflatable as a whole and the individual compartments in such portions are not segregated from one another so as to be capable of regulating the individual configuration or force exerted thereby on the user.

Accordingly, the above-cited U.S. Patents are representative of a number of structures which are both available in the prior art and commercially available in the marketplace. However, certain types of structures represented by these patents also have less versatility than that frequently desired by persons utilizing such structures.

More specifically, there is a great need in the industry for the development of a structure which has a plurality of independently, fluid or air segregated compartments wherein the fluid in each of the compartments may be regulatable to the extent that the configuration of each compartment may be independently varied. With this type of versatility, various portions of the user's back may be supported independently of one another and in the precise manner desired by the user.

The development of such a structure, while having the above-noted versatility, should not be overly complex, which would have the effect of adding both to the cost and maintenance of the intended structure.

SUMMARY OF THE INVENTION

This invention relates to a back support structure in the form of a cushion or the like element. More specifically, the back support has a blocking member or base with a plurality of compartment means attached thereto. Each of the compartment means are attached to the backing member in substantially sealed, fluid or air segregated relation to one another wherein each of the compartment means may be filled with fluid or air, either in the form of air or liquid, as will be explained in greater detail hereinafter.

In one embodiment of the present invention the back support comprises a plurality of compartment means arranged in substantially parallel, adjacent relation to one another along their longitudinal dimension. Each of the compartment means are arranged substantially transversely to the "upright" axis of the backing member so as to be disposed essentially across the back portion of the user. Each of the compartment means includes a valve assembly which comprises a two-way valve capable of selectively allowing fluid to flow into and out of the particular compartment means so as to control its configuration and, accordingly, the amount of pressure being exerted on a particular portion of the body or back of the user.

In another embodiment of the present invention, each of the compartment means are dimensioned to include a substantially greater volume of fluid relative to the preceding compartment means mounted on the backing member.

In yet another embodiment of the present invention, the valving assembly may comprise a first and second valve member wherein the first valve member is specifically designed and structured to regulate the flow of gas or air into and out of a given compartment means. The second valve member of the valve assembly as designed to regulate the flow of liquid into and out of the given compartment means. Accordingly, both air and liquid may be placed in the same compartment means and, furthermore, the liquid may be heated so as to transfer heat through the specific compartment means to a particular portion of the back of the user.

In yet another embodiment of the present invention the compartment means may be arranged in sets and disposed in pairs in substantially aligned, end-to-end relation to one another. In this emodiment, each compartment means of each set extends from one lateral edge or perimeter portion of the backing member to a junction line disposed along the substantial center of the backing member. For ease of transport and disposition, the entire back support may be folded along this junction line. This allows for varying pressue to be exerted on opposite sides of the back of the user to be exerted thereon in dependently of one another.

In operation, each of the various compartment means are filled with either air and/or liquid to substantially their capacity and positioned on a supporting surface, such as a chair or the like, designed for use. The user, thereafter, rests against the back support and, in doing so, specifically adjusts the configuration of each of the individual compartment means by removing the fluid or air from the individual compartment means. This means fluid removal is continued until the desired pressure or cushioning force is being exerted against the particular portion of the back or body which it engages. In this manner, the back support is specifically configured and adapted for use by a particular user and provides adequate and desired support in the exact, specific region desired. If liquid is used in any or all of the various compartment means, such liquid may be preheated and thereby add additional comfort to the desired portion or region of the user's body. Mere manipulation of the valve assemblies, of either the first or second valve members can, of course, regulate the flow of air or liquid into and out of the various compartment means.

The invention accordingly comprises the features of construction, combination of elements and arrangement of parts which will be exemplified in the construction here inafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a side view of the back support of the present invention oriented on a supporting structure such as a chair or the like.

FIG. 2 is a front view of the embodiment of FIG. 1.

FIG. 3 is a sectional view of yet another embodiment of the present invention wherein the various compartment means have different capacities.

FIG. 4 is a front view of yet another embodiment of the present invention.

FIG. 5 is a detailed view in partial cutaway and section showing the valve assembly and the interior of certain compartment means of the present invention.

FIG. 6 is a cross sectional view of yet another embodiment of the present invention in corporating a substantially rigid support member.

Similar reference characters refer to similar parts throughout the several views of the drawings.

DETAILED DESCRIPTION

As shown in FIGS. 1 and 2, the back support of the present invention is generally indicated as 10 and comprises a base means including a backing member 12. A plurality of compartment means 14 are mounted on the backing member 12 in sealed, fluid segregated relation to one another as shown. The embodiment shown in FIG. 1 comprises each of the compartment means 14 disposed in substantially transverse relation to the upright axis of the backing member as the back support is oriented in FIGS. 1 and 2. In this disposition, each of the compartment means are disposed across or transverse to the spine of the back of the user.

In addition, each of the compartment means includes a valve assembly generally indicated as 18. In the embodiments of FIGS. 1, 2 and 4, the valve assembly comprises a single valve structured to have a two-way flow so that fluid may flow into and out of the interior of the various compartment means 14 as desired. With regard to the embodiment shown in FIG. 5, the valve assembly comprises a first valve element 20 and a second valve element 22. The first valve element 20 is structured to have air or like gas pass therethrough into the interior of the compartment means 14. The second valve element 22 is structured to have liquid, in the form of water or other such liquid, pass into or out of the various compartment means 14. Accordingly, in this embodiment, the liquid 24 may simultaneously exist on the interior of the compartment means 14 with the gas 26. In addition, the liquid 24 may be heated so as to add to the comfort of the user of the back support by passing heat thereto.

Yet another embodiment of the present invention is disclosed in FIG. 3 wherein each of the successive compartment means 14 have successively greater dimension so as to allow a greater amount of fluid to pass therein. Accordingly, the configuration of the individual compartment means 14 is different. Also, the amount of force exerted on particular areas or regions of the back may also differ according to the pressure of the individual compartment means 14.

Yet another embodiment of the present invention comprises the structure shown in FIG. 4 wherein at least two of the compartment means 16 are arranged in sets or pairs. More specifically, the compartment means 16 are disposed in end-to-end aligned relation to one another wherein one end of each of the compartment means 16 is disposed adjacent to a perimeter portion generally indicated as 29. The opposite end of said compartment means 16 in this embodiment is contiguous to or adjacent to the approximate center of the backing member 12. This center is defined by seam 30 which serves as a junction for the correspondingly positioned ends of each of the compartment means 16 forming the individual pairs. The structure of the junction line 30 is such that the entire backing member 12 can be folded along this line if so desired for storage and transportation of the back support. This structure allows for the regulation of each side of the back support independently of the other. This serves to regulate the pressure on the right and left side of the back of the user independently of one another.

With regard to the embodiment of FIG. 6 a support means 40 is disposed in adjacent, engaging relation to backing member 12. More specifically, support means 40 comprises a substantially rigid sheet configured to engage a sufficient portion of backing member 12 to support in a substantially upright orientation. An auxillary flap member 42 from a flexible material and is disposed in overlapping relation to support means 40 is disposed on the interior of flap 42 and backing member 12. In this disposition the entire back support 10 is maintained in an upright position thereby allowing the compartment mean 14 to respond from a non-flexible position.

In operation, fluid in the form of either gas or liquid is entered into the interior of each of the compartment means 14 and/or 16. The user of the device then positions the back support adjacent predetermined portions of a seat or like supportive structure generally indicated as 32. The user then positions his back or other predetermined portion of his body against the back support and manipulates the valve assemblies 18 to allow certain amounts of fluid in each compartment to escape. Accordingly, each of the compartments 14 or 16 are thereby specifically contoured to fit the shape of the back or other portion of the body of the user. Along these same lines, the desired amount of pressure can be exerted along specific regions of the back or body portion so as to exert the exact amount of pressure thereon without unnecessarily "burdening" other portions of the back or body.

It will thus be seen that the object made apparent from the preceding description are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Now that the invention has been described,

What is claimed is:

1. An adjustable back support adapted for use on an existing chair comprising: base means including a backing member, a plurality of compartment means mounted on said backing member in adjacent, fluid segregated relation to one another, each of said plurality of compartments including at least a portion disposed in substantially transverse relation to the upright axis of said backing member, each of said compartments being in immediate adjacent parallel relation to one another, valving means disposed in fluid flow regulating relation between the interior and the exterior of said plurality of compartment means, each of said compartment means secured to said backing member in fluid tight engagement therewith, whereby the volume of fluid within each of said compartment means is independently regulated through manipulation of said valving means, support means including a sheet element configured to substantially correspond to at least a portion of said backing member, said sheet element being formed from a substantially rigid material, whereby said sheet element is disposed to orient said backing member in a substantially upright orientation, and each of said plurality of compartments being disposed in transverse relation along the entire length of said support means, said valving means comprising a two-way valve assembly mounted in each of said compartment means, whereby fluid may selectively flow into and out of each of said compartment means independently.

2. An adjustable back support as in claim 1 wherein at least one of said valving means comprises a plurality of valve assemblies, a first of said plurality of valve assemblies structured to regulate flow of liquid into and out of the interior of said one compartment means.

3. An adjustable back support as in claim 2 wherein a second of said valve assemblies is structured to regulate flow of gas into and out of the interior of said one compartment means, said first and second valve assembly disposed in fluid segregated relation to one another, whereby both liquid and gas is selectively regulated into and out of the interior of said one compartment independently of one another.

4. An adjustable back support as in claim 3 wherein each of said first and second valve assemblies include a selectively manipulatable two-way valve structure.

5. An adjustable back support as in claim 1 wherein said plurality of compartment means are disposed in at least two sets, each compartment of each set disposed in successive, adjacent relation to one another, each set disposed in substantially side-by-side relation to one another.

6. An adjustable back support as in claim 5 wherein each of said compartment means of each set is disposed in substantially transverse relation to the upright axis of said backing member, and extending from one end to the approximate center of said backing member.

7. An adjustable back support as in claim 1 wherein each of said compartment means is substantially equally dimensioned and configured to hold substantially equal volumes of fluid therein.

8. An adjustable back support as in claim 1 wherein the dimension of each compartment means is successively greater relative to the preceding compartment means from one end of said backing member to the other, whereby each of said compartment means holds different maximum volume of fluid on the interior thereof.

* * * * *

UNITED STATES PATENT OFFICE

CERTIFICATE OF CORRECTION

Patent No. 4,067,078 Dated January 10, 1978

Inventor(s) Emanuel A. Winston

It is certified that error appears in the above-identified patent and that said Letters Patent are hereby corrected as shown below:

Column 2, line 7, "blocking" should read -- backing --.

Column 2, line 39, "as" should read -- is --.

Column 2, line 49, "emodiment" should read -- embodiment --.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*